United States Patent [19]

Malone

[11] Patent Number: 4,538,088

[45] Date of Patent: Aug. 27, 1985

[54] SPARK GAP DEVICE

[75] Inventor: Edgar W. Malone, Goleta, Calif.

[73] Assignee: Reynolds Industries, Inc., Los Angeles, Calif.

[21] Appl. No.: 521,985

[22] Filed: Aug. 11, 1983

[51] Int. Cl.[3] ..... A47B 88/00

[52] U.S. Cl. ..... 313/325; 313/231.11; 360/120

[58] Field of Search ..... 313/325, 231.11; 315/38; 360/120; 333/238

[56] References Cited

U.S. PATENT DOCUMENTS 2,936,390 5/1960 Melhart ..... 313/325 X

FOREIGN PATENT DOCUMENTS 47242 9/1972 Australia ..... 313/325
3034887 4/1982 Fed. Rep. of Germany ..... 313/325
2418541 10/1979 France ..... 313/325

*Primary Examiner*—Robert Lindsay
*Attorney, Agent, or Firm*—Pretty, Schroeder, Brueggemann & Clark

[57] ABSTRACT

A spark gap device adapted for a direct, low-inductance connection to a foil strip transmission line having a pair of foil conductor strips located on the opposite sides of an insulator strip. The device includes a pair of electrodes spaced a predetermined distance apart from each other such that an arc discharge current can selectively flow from one electrode to the other. One electrode includes an integral threaded shaft projecting from its back side through a hole in the transmission line, where a clamp ring and retaining nut make electrical contact with the foil conductor strip on the transmission line's far side. The other electrode includes an integral cylindrical wall surrounding the first electrode and terminating in a ring-shaped surface that makes electrical contact with the foil conductor on the transmission line's near side.

5 Claims, 4 Drawing Figures

SPARK GAP DEVICE

BACKGROUND OF THE INVENTION

This invention relates generally to spark gap or arc discharge devices, and, more particularly, to devices of this kind that are adapted for connection to a foil strip transmission line.

Spark gap devices of this general kind, including both triggered and non-triggered devices, are useful in a number of applications, such as exploding bridgewire circuits, modulator driver and crowbar circuits, and other energy transfer circuits. These devices typically include a pair of electrodes and an insulator for spacing the electrodes a predetermined distance apart from each other. The insulator also functions to define a closed chamber that includes the space between the electrodes and that is adapted to be filled with a gas or vapor. In the case of triggered spark gap devices, a current discharge between the two main electrodes is triggered by a control signal coupled between one of the electrodes and a closely adjacent trigger electrode.

Conventional spark gap devices of the kind described above have included separate electrical terminals connected to each electrode. The terminals are adapted for connection to a cable or other electrical conductor, and typically take the form of elongated pins or threaded shafts. The terminals are usually located at the opposite ends of the spark gap device.

In some applications, the spark gap device must be connected to a foil strip transmission line, i.e., strip line, which includes two foil conductor strips located on opposite sides of a flat insulator strip. In the past, there has not been a convenient arrangement for electrically connecting spark gap devices of this kind to such strip lines, especially one that provides a low-inductance current path. There is therefore a need for a spark gap device configuration that lends itself to a direct, low-inductance connection to a two-conductor strip line. The present invention fulfills this need.

SUMMARY OF THE INVENTION

The present invention is embodied in a spark gap device especially adapted for direct connection to a foil strip transmission line. The device includes first and second electrodes, and insulator means for spacing the two electrodes a predetermined distance apart from each other and for defining a closed chamber that includes the space between the electrodes. This closed chamber is adapted to contain a gas or vapor, such that a relatively large electrical current can, under appropriate circumstances, pass from one electrode to the other. The device of the invention further includes first and second conductor means electrically connected to the respective first and second electrodes. In accordance with the invention, the first conductor means includes an elongated shaft and a ring-shaped electrical terminal, and the second conductor means includes a cylindrical wall terminating in a ring-shaped electrical terminal that confronts, but is spaced from, the ring-shaped terminal of the first conductor means. The first and second conductor means are sized to permit placement of a two-conductor foil strip transmission line between their respective confronting ring-shaped terminals, with each terminal contacting a separate foil conductor of the strip line. The spark gap device can thereby be conveniently secured to the strip line in a direct fashion, providing a low-inductance path for any electrical current and avoiding the need for any intervening wires or cables.

In other aspects of the invention, the elongated shaft of the first conductor means is threaded and the ring-shaped terminal is in the form of a washer or clamp ring encircling the shaft and held in place by a nut. The threaded shaft can project through a hole formed in the strip line, and rotation of the nut tightens the clamp ring against the foil conductor on the far side of the strip line.

The cylindrical wall of the second conductor means is preferably coaxial with the shaft of the first conductor means, and its ring-shaped terminal is adapted to press against the foil conductor on the near side of the strip line, encircling the hole through which the threaded shaft projects. The portion of the foil conductor on the near side of the strip line, between the hole and the cylindrical wall, is preferably removed, to prevent the possibility of contact between it and the first electrode and threaded shaft.

Other features and advantages of the present invention will become apparent from the following description of the preferred embodiment, taken in conjunction with the accompanying drawings, which illustrate, by way of example, the principles of the invention.

DESCRIPTION OF THE PREFERRED EMBODIMENT

Figure 1:
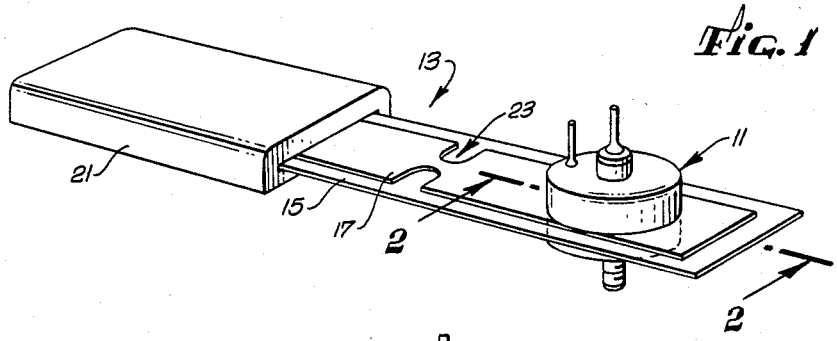
FIG. 1 is a perspective view of a triggered spark gap device embodying the present invention, the device being shown secured to a two-conductor foil strip transmission line.
Figure 4:
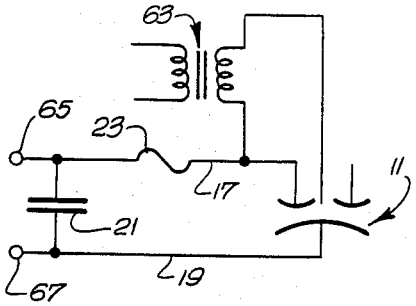
FIG. 4 is a schematic diagram of an exploding bridgewire circuit that includes the spark gap device as one of its elements.

As shown in the exemplary drawings, the present invention is embodied in a spark gap device 11 especially adapted for connection to a foil strip transmission line 13 of the type having a flat central insulator strip 15 and upper and lower foil conductor strips 17 and 19 cemented or otherwise secured to its opposite sides. FIGS. 1 and 4 depict the device as being part of an exploding bridgewire circuit, in which the device is used to discharge an electrical charge stored on a capacitor 21 through a bridgewire in the form of a necked-down portion 23 of the upper conductor strip 17 of the strip line. This vaporizes the necked-down portion and thereby initiates an explosion in an explosive pellet (not shown).

Figure 2:
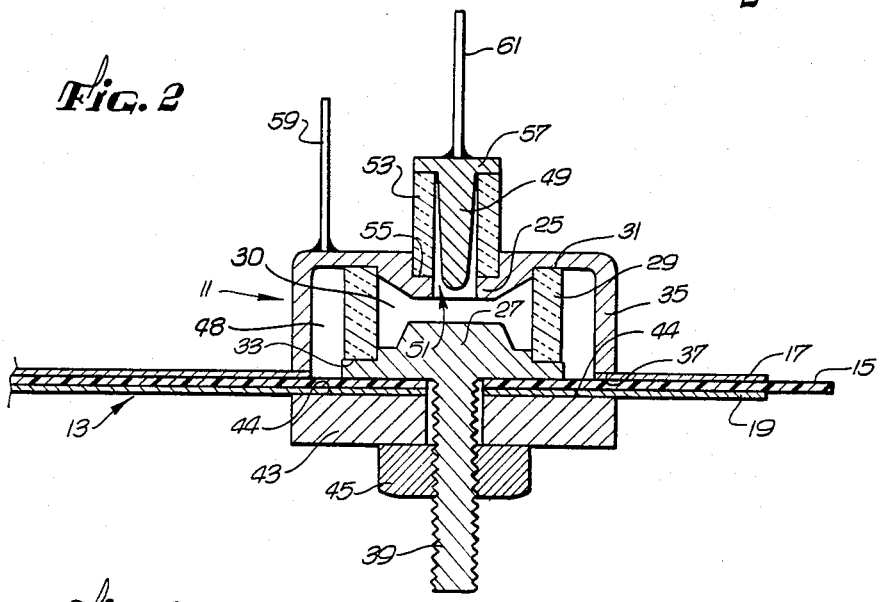
FIG. 2 is a cross-sectional view of the spark gap device and foil strip transmission line, taken in the direction of the arrows 2—2 in FIG. 1.
Figure 3:
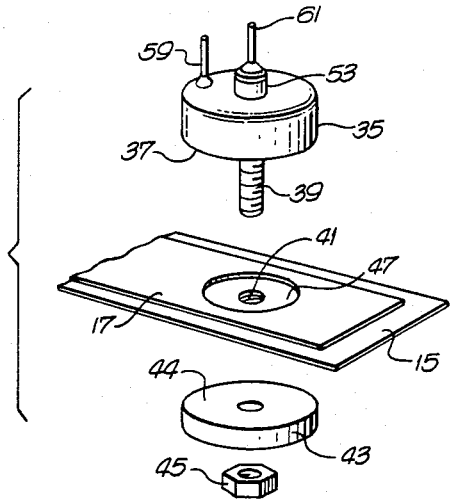
FIG. 3 is an exploded perspective view of the spark gap device.

With particular reference to FIG. 2, the spark gap device 11 includes an upper dome electrode 25 and a lower dome electrode 27 held in confronting, spaced relationship by a hollow-cylindrical insulator 29. This defines a closed chamber 30, which can be filled with an ionizable gas to facilitate a discharge of electrical current between the electrodes. The upper and lower electrodes are circumferentially symmetrical and include annular shoulders 31 and 33, respectively, for receiving the opposite ends of the insulator. The electrodes are spaced apart from each other by a distance, e.g., 0.030 to 0.050 inches, corresponding to the device's desired breakdown voltage.

In accordance with the invention, the upper and lower dome electrodes 25 and 27 are adapted for direct connection to the respective upper and lower foil conductors 17 and 19 of the strip line 13. In particular, the upper electrode is connected via an integral cylindrical wall 35 depending from the outer periphery of the electrode's annular shoulder 31. This wall lies outside, but is coaxial with, the cylindrical insulator 29, and it terminates in a ring-shaped surface or terminal 37 adapted to contact the upper foil conductor 17 of the strip line 13. This forms a low-inductance path between the upper electrode and the upper foil conductor.

The lower dome electrode 27 is connected to the lower foil conductor 19 of the strip line 13 via a threaded shaft 39 that depends from the electrode's backside and projects through a hole 41 formed through the strip line. A washer or clamp ring 43 encircles the shaft, on the far side of the strip line, and its upper surface 44 forms a ring-shaped terminal that is pressed against the lower foil conductor by means of a nut 45. This provides a low inductance path between the lower electrode and the lower foil conductor.

The outside diameters of the cylindrical wall 35 and clamp ring 43 are substantially identical to each other, and the nut 45 can be used to urge them toward each other, to press against the opposite sides of the strip line 13. In this way, the wall and clamp ring make positive electrical contact with the two respective foil conductors 17 and 19 of the strip line.

The upper foil conductor 17 of the strip line 13 is cut away in a ring-shaped region 47 between the hole 41 and the inner edge of the upper electrode terminal 37. This prevents a short circuit between the upper foil conductor and the backside of the lower electrode 27. The backside of the lower electrode therefore contacts the strip line's central insulator strip 15.

The annular shoulder 31 of the upper electrode 25 is sized such that a substantial gap 48 is formed between the inner periphery of the cylindrical wall 35 and the outer periphery of the lower electrode 27. This ensures that electrical current will arc between the two electrodes 25 and 27 only in the chamber 30 defined by the electrodes and the cylindrical insulator 29. The gap between the wall and the insulator can be filled with either air, as shown in FIG. 2, or a suitable potting material.

The cylindrical wall 35 is sized such that tightening of the nut 45 brings it into contact with the upper foil conductor 17 before the backside of the lower electrode 27 is brought into contact with the region 47 of the central insulator strip 15. The wall flexes in response to the compressive force it receives, to ensure that it maintains continuous electrical contact with the upper foil conductor.

In the preferred embodiment, the spark gap device 11 further includes an elongated trigger electrode 49 located in close proximity to the upper dome electrode 25. In a conventional fashion, a trigger signal of prescribed magnitude can be coupled between the trigger electrode and the upper dome electrode, to initiate a discharge of the charge stored in the capacitor 21 across the gap between the two dome electrodes 25 and 27.

More particularly, the trigger electrode 49 is located within a hole 51 formed through the center of the upper dome electrode 25. The trigger electrode is supported by a hollow-cylindrical insulator 53, one end of which rests in an annular shoulder 55 formed in the back side of the upper electrode, adjacent to the central hole, and the other end of which rests against an annular flange 57 projecting outwardly from the trigger electrode, itself.

Terminal pins 59 and 61 are soldered to the backsides of the respective upper dome electrode 25 and trigger electrode 49, to permit application of the trigger signal described above. As shown schematically in FIG. 4, this trigger signal can be supplied by the secondary winding of a suitable transformer 63. Terminals 65 and 67 (FIG. 4) can be used to initially charge the capacitor 21.

As is conventional, the upper dome electrode 25 and integral wall 35 can be formed of a highly conductive material such as copper. The bottom dome electrode 27 can be formed of a conductive material such as Kovar, which is a commonly-used alloy of iron, nickel and cobalt. The clamp ring 43 and nut 45 are preferably formed of brass, and the two hollow-cylindrical insulators 29 and 53 are preferably formed of a ceramic material, which can be brazed to the respective electrodes. Forming the lower electrode of Kovar alloy facilitates the brazing of the ceramic insulator 29 because the two materials have coefficients of thermal expansion that are substantially identical. The foil conductors 17 and 19 of the strip line 13 are typically formed of copper, while the flat insulator strip 15 is typically formed of an electrically-insulating material such as Kapton.

It should be appreciated from the foregoing description that the present invention provides an improved spark gap device particularly suitable for use with a foil strip transmission line of the type that includes two foil conductor strips located on opposite sides of a flat insulator strip. The device includes two electrodes that are arranged in spaced relationship, each being electrically coupled to a separate foil conductor on the strip line by a flat ring-shaped electrical terminal. The two ring-shaped terminals are of substantially the same size and are arranged in confronting relationship, spaced apart sufficiently to permit positioning of the strip line between them.

Although the invention has been described in detail with particular reference to the preferred embodiment, it will be understood by those of ordinary skill in the art that various modifications can be made without departing from the invention. Accordingly, the invention is limited only by the following claims.

I claim:

1. A spark gap device comprising:

first and second circumferentially-symmetrical electrodes;

a hollow-cylindrical insulator for positioning the first and second electrodes in a confronting relationship, a predetermined distance apart from each other, and for defining a closed chamber that includes the space between the electrodes;

an elongated shaft projecting from the side of the first electrode opposite the second electrode, the shaft being threaded and electrically conductive;

an electrically-conductive washer encircling the shaft and having a flat, ring-shaped surface that faces the first electrode;

an electrically-conductive retaining nut threadedly engaging the shaft and retaining the washer; and an electrically-conductive cylindrical wall projecting from the second electrode and surrounding the cylindrical insulator, the wall terminating in a flat, ring-shaped surface coaxial with the flat, ring-shaped surface of the washer, the two surfaces having substantially the same outer diameters and confronting each other in spaced relationship;

wherein the washer and cylindrical wall are sized and located to permit placement of a flat, two-conductor foil strip transmission line between their respective confronting ring-shaped surfaces, with one surface contacting a first foil conductor of the transmission line and the other surface contacting a second foil conductor of the transmission line.

2. A spark gap device as defined in claim 1, wherein the cylindrical wall is integral with the second electrode.

3. A spark gap device comprising:

first and second circumferentially-symmetrical electrodes;

a hollow cylindrical insulator for positioning the first and second electrodes in a confronting relationship, a predetermined distance apart from each other, and for defining a closed chamber that includes the space between the electrodes;

an electrically-conductive clamp having a flat, ring-shaped surface;

complementary threaded means carried by the clamp and the first electrode, on the side of the first electrode opposite the second electrode, the threaded means retaining the clamp in a position with its ring-shaped surface facing the first electrode;

an electrically-conductive cylindrical wall projecting from the second electrode and surrounding the cylindrical insulator, the wall terminating in a flat, ring-shaped surface coaxial with the flat, ring-shaped surface of the clamp, the two surfaces having substantially the same outer diameters and confronting each other in spaced relationship;

wherein the clamp and the cylindrical wall are sized and located to permit placement of a flat, two-conductor foil strip transmission line between their respective confronting ring-shaped surfaces, with one surface contacting a first foil conductor of the transmission line and the other surface contacting a second foil conductor of the transmission line.

4. A spark gap device as defined in claim 3, wherein:

the complementary threaded means includes an elongated shaft projecting outwardly from the first electrode, on the side of the first electrode opposite the second electrode, the shaft being threaded and electrically conductive, and an electrically-conductive retaining nut threadedly engaging the threaded shaft;

the clamp includes a central opening through which the shaft projects, such that the clamp's flat, ring-shaped surface faces the first electrode; and the retaining nut retains the clamp in its prescribed position.

5. A spark gap device as defined in claim 3, wherein the cylindrical wall is integral with the second electrode.

* * * * *